United States Patent [19]

Higuchi

[11] 4,163,621

[45] Aug. 7, 1979

[54] METHOD FOR FORMING A CONTINUOUS FOOTING WITH PREFABRICATED FOOTING BLOCKS

[76] Inventor: Tadayasu Higuchi, 5-6-15, Sakuragaoka, Setagaya-ku, Tokyo, Japan

[21] Appl. No.: 875,975

[22] Filed: Feb. 8, 1978

[51] Int. Cl.[2] ..... E02D 5/50

[52] U.S. Cl. ..... 405/255; 52/742

[58] Field of Search ..... 61/56, 53.5, 56.5, 50; 52/742; 405/233, 239

[56] References Cited

U.S. PATENT DOCUMENTS

| | | | |
|---|---|---|---|
| 1,665,797 | 4/1928 | Sipe | 61/50 |
| 1,811,479 | 6/1931 | Squire | 61/50 |
| 3,429,129 | 2/1969 | Johansson | 61/53.5 |
| 4,043,133 | 8/1977 | Yegge | 61/50 |

FOREIGN PATENT DOCUMENTS

| | | | |
|---|---|---|---|
| 669281 | 8/1963 | Canada | 61/53.5 |

*Primary Examiner*—John E. Mortach

*Attorney, Agent, or Firm*—Ladas, Parry, Von Gehr, Goldsmith & Deschamps

[57] ABSTRACT

A method for forming a continuous footing for a large building to be built on a concrete pile foundation using pre-fabricated footing blocks is disclosed. A novel leveling element which comprises a base plate having an aperture for receiving the top of a pile remaining above the ground level and side walls having indentations for receiving at least one pre-fabricated footing block is used, whereby a continuous footing can be formed with pre-fabricated footing blocks on the piles the tops of which remain above the ground level with uneven heights.

10 Claims, 7 Drawing Figures

Fig. 1
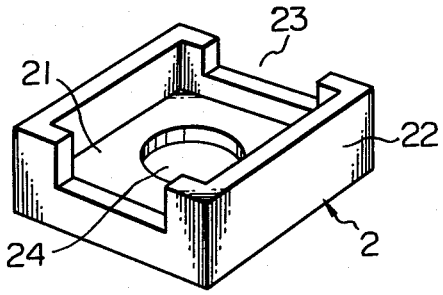
Fig. 3
Fig. 2
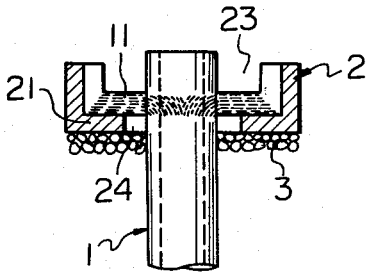
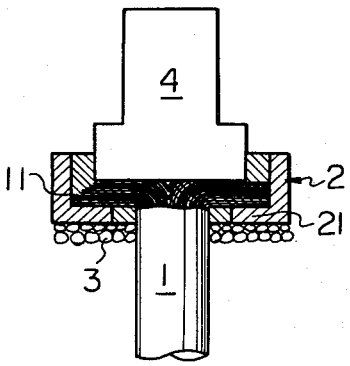

METHOD FOR FORMING A CONTINUOUS FOOTING WITH PREFABRICATED FOOTING BLOCKS

BACKGROUND OF THE INVENTION

In building dwelling houses, pre-fabricated footing blocks now have come into use. However, pre-fabricated footing blocks cannot be used for larger buildings which are constructed on a pile foundation. Because it is impossible to make exactly equal the levels of the tops of all the piles after they have been driven into the soil, and therefore a level footing cannot be obtained by placing pre-fabricated footing blocks thereupon. Thus, in the construction of such larger buildings, the continuous footings are formed in the conventional manner on the building site. The object of this invention is to provide a new method for forming a continuous footing for a large building to be built on a concrete pile foundation and a new leveling element which is used for said new method.

SUMMARY OF THE INVENTION

This invention provides a leveling element for pre-fabricated footing blocks, said leveling element comprises a base plate having an aperture for receiving the top of a pile and side walls having indentations or recesses for receiving a pre-fabricated footing block or blocks.

Further, this invention provides a method for forming a continuous footing for constructing a building on a concrete pile foundation comprising: placing a leveling element comprising a base plate having an aperture for receiving the top of a concrete pile and side walls having indentations at each pile so that said aperture receives the top of each of concrete piles remaining above the ground level after they have been driven into the soil, breaking the top of the concrete piles so as to expose the reinforcing bars of the piles, bending down the exposed reinforcing bars onto the surface of the base plate, placing pre-fabricated footing blocks so that at least a part of each block is received in one of the indentations.

Usually, before the leveling elements are placed, a ballast (rubble and gravel and sand if necessary) bed is formed in accordance with the layout of the building to be built, and it is leveled all over the layout before the leveling elements are placed.

The leveling element can be made of metal, but it is usually made of ferroconcrete. The standard shape of the leveling element is square or rectangular in the plan view and like a body of a box. But it can be cross or T-shape or even round in the plan view.

Now the invention is described in detail with reference to the attached drawings.

BRIEF DESCRIPTION OF THE DRAWINGS

FIG. 1 is a perspective view of a leveling element of the standard type in accordance with this invention.

FIG. 2 is a schematic cross-sectional view of the leveling element of FIG. 1 showing it in the position to receive the top of a concrete pile.

FIG. 3 is a schematic cross-sectional view of the footing prepared according to the method of this invention.

DETAILED DESCRIPTION OF THE INVENTION

Figure 4:
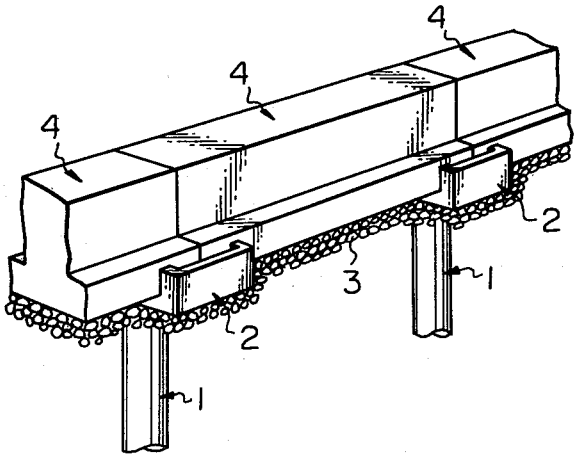
FIG. 4 is a schematic perspective view of a part of a continuous footing formed by the method of this invention.

The leveling element of this invention typically has a shape as shown in FIG. 1. The element 2 comprises a base plate 21 and side walls 22. In this case, the plan is square and therefore there are four side walls. In the base plate 21, an aperture 24 is provided. The aperture is usually round, but it is not limited thereto. The size of the aperture is considerably larger than the cross section of the concrete pile to be used, so that the element is easily placed on the pile and its position can be easily adjusted, if piles are not located at quite exact positions on a straight line. In each of the two opposite sides of the four side walls, an indentation 23 which receives a part of a pre-fabricated footing block is provided. The width of the indentation is almost the same as the width of the footing block to be used. The height of the remaining part of the side wall in which an indentation 23 is provided is explained later.

The pre-fabricated footing block per se is known. It typically is a long ferroconcrete block comprising a base slab and a ridge having an inverted T shape transverse cross section, this invention is explained with respect to this typical type of pre-fabricated footing block, although the method of this invention is not limited thereto.

Concrete piles are driven into the soil by the conventional method at the positions selected according to the layout of a building to be constructed. After they have been driven into the soil, a small portion of each pile remains above the ground level. But the height or level of the remaining tops of the piles are not even, as mentioned before.

Along the lines connecting the piles according to the designed layout, trenches are dug, and rubble and gravel are placed in the trenches and leveled so as to form the bed for the footing. The bed may be solidified by adding mortar or cement milk. Leveling elements such as shown in FIG. 1, for instance, are placed so that their apertures receive the top of the piles and are oriented so that the indentations are aligned. FIG. 2 shows a leveling element 2 placed on the bed 3 so that the top of a pile 1 extends upward through the aperture 24.

Usually, it is impossible to make the centers of all the piles exactly accord with the designed center lines of the continuous footing. As mentioned above, however, the cross section (diameter) of the aperture in the leveling block is considerably larger than the cross section (diameter) of the piles. Therefore, the leveling elements can be placed exactly on the designed footing lines. Thus the continuous footing can be formed exactly in accord with the designed layout regardless of offset in the center of the pile tops.

After the leveling elements have been placed, the tops of the piles extending upward through the apertures of the leveling elements are broken so as to expose the reinforcing bars. As shown in FIG. 2, the exposed bars 11 are bent down onto the surface of the base plate 21. (It is needless to say that if the leveling element is dislocated during the work of breaking the concrete and bending the reinforcing bars, the leveling element must be relocated.)

Thereafter, the reinforcing bars and the leveling element are fixed by filling mortar, whereby the space between the aperture and the pile is filled.

After all the leveling elements have been fixed, prefabricated footing blocks are placed in the trenches so that each block bridges two leveling elements with the end being received in an indentation thereof as shown in FIGS. 3 and 4. The blocks are fixed to the leveling elements by filling mortar in the space between the block and the side walls of the leveling elements. (FIG. 4 shows the state in which said space is not yet filled with the mortar.)

The method for compacting the bed under the footing blocks described in the copending application No. 873,625, now U.S. Pat. No. 4,124,963, can be applied to the method of this invention. Although it is not practical, it is possible to lay the footing blocks without leveling the ballast bed, and to finish the top surface of the formed continuous footing so as to level it.

Figure 5:
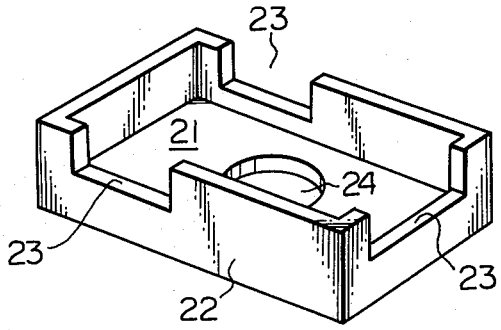
FIGS. 5, 6 and 7 are perspective views of other embodiments of the leveling element of this invention.
Figure 6:
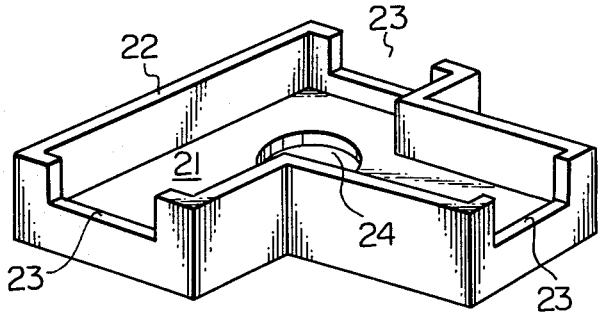
Figure 7:
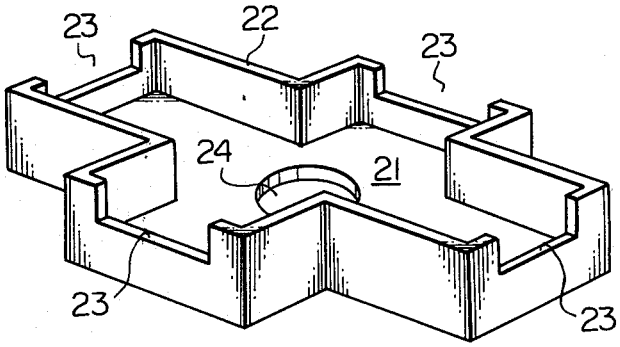

The leveling element shown in FIG. 1 is used for connecting pre-fabricated footing blocks in a straight line. The leveling element shown in FIGS. 5 and 6 is used for T junction. In the embodiment of FIG. 5, indentations 23 are provided in three side walls in a rectangular element. In the embodiment of FIG. 4, the plan of the base plate 21 is a T shape, and indentations are provided in the three end walls. This element covers a larger area than the embodiment of FIG. 3. The leveling element shown in FIG. 7 is for a cross junction. In this emboidment, indentations are provided in the end of the cross bars. Other various shapes are employable, a square leveling element with an indentation in each of the two adjoining side walls, a square leveling element with an indentation in each of the three side walls, a square leveling element with an indentation in each side walls, etc. It is self-explanatory from the above explanation that the height of the remaining part of the side wall in which an indentation is provided must be larger than the thickness of the bundle of the bent-down reinforcing bars. Other dimensions will be easily determined by those skilled in the art.

The leveling elements of this invention can be easily manufactured by those skilled in the art by the conventional art with the conventional materials and therefore there is no necessity to explain how to manufacture it in detail.

Having described by invention, I claim:

1. A method for forming a continuous footing for constructing a building on a concrete pile foundation comprising: placing a leveling element comprising a base plate having an aperture for receiving the top of a concrete pile and side walls having indentations at each pile so that said aperture receives each of the tops of the concrete piles remaining above the ground level after they have been driven into the soil, breaking the tops of the concrete piles so as to expose the reinforcing bars of the piles, bending down the exposed reinforcing bars onto the surface of the base plate, fixing the pile and the leveling element by filling mortar, placing pre-fabricated footing blocks so that at least a part thereof is received in one of the indentations, thus forming a continuous footing, and fixing the footing blocks.

2. The method as claimed in claim 1, wherein trenches are dug in accordance with the layout of the pile foundation and a ballast bed is formed therein, compacted and leveled before the leveling elements are placed.

3. The method as claimed in claim 2, wherein the bed is solidified by concrete.

4. The method as claimed in claim 1, wherein leveling elements which are square in the plan view, have a round aperture in the base plate thereof, and have an indentation in each of the two opposite side walls are used.

5. The method as claimed in claim 1, wherein leveling elements which are square in the plan view, have a round aperture in the base plate thereof, and have an indentation in each of the two adjoining side walls are used.

6. The method as claimed in claim 1, wherein leveling elements which are square in the plan view, have a round aperture in the base plate thereof, and have an indentation in each of three side walls are used.

7. The method as claimed in claim 1, wherein leveling elements which are square in the plan view, have a round aperture in the base plate thereof, and have an indentation in each of the four side walls are used.

8. The method as claimed in claim 1, wherein leveling elements which are a T shape in the plan view, have a round aperture in the base plate thereof, have an indentation in each of the three end walls thereof are used.

9. The method as claimed in claim 1, wherein leveling elements which are a cross in the plan view, have a round aperture in the base plate thereof, and have an indentation in each of the four end walls thereof are used.

10. The method as claimed in claim 1, wherein leveling elements which are round in the plan view are used.

* * * * *